US006310581B1

(12) United States Patent
Stockhammer

(10) Patent No.: US 6,310,581 B1
(45) Date of Patent: Oct. 30, 2001

(54) PASSAGE CONTROL DEVICE FOR NON-CONTACTING DATA CARRIERS

(75) Inventor: Rudolf Stockhammer, Sankt Gilgen (AT)

(73) Assignee: SkiData AG, Gartenau (AT)

( * ) Notice: Subject to any disclaimer, the term of this patent is extended or adjusted under 35 U.S.C. 154(b) by 0 days.

(21) Appl. No.: 09/601,388

(22) PCT Filed: Jun. 14, 1999

(86) PCT No.: PCT/EP99/04083

§ 371 Date: Jul. 28, 2000

§ 102(e) Date: Jul. 28, 2000

(87) PCT Pub. No.: WO00/04511

PCT Pub. Date: Jan. 27, 2000

(30) Foreign Application Priority Data

Jul. 15, 1998 (DE) ..... 198 31 767

(51) Int. Cl.[7] ..... H01Q 1/12

(52) U.S. Cl. ..... 343/718; 235/382; 340/522

(58) Field of Search ..... 343/718, 797, 343/806, 807, 808, 809, 810; 235/380, 382, 384; 340/522, 825.44; H01Q 1/12

(56) References Cited

U.S. PATENT DOCUMENTS

| | | | | |
|---|---|---|---|---|
| 4,822,990 | * | 4/1989 | Tamada et al. | 235/492 |
| 5,202,550 | * | 4/1993 | Kocznar et al. | 235/382 |
| 5,478,995 | * | 12/1995 | Wallerstorfer et al. | 235/382 |
| 5,634,209 | * | 5/1997 | Prudhomme et al. | 455/345 |
| 5,886,634 | * | 3/1999 | Muhme | 340/572 |

FOREIGN PATENT DOCUMENTS

| | | |
|---|---|---|
| 94 90 094 | 2/1996 | (DE) . |
| 0563 017 | 9/1993 | (EP) . |
| 0 645 840 | 3/1995 | (EP) . |
| 2 624 677 | 6/1989 | (FR) . |
| 2 295 297 | 5/1996 | (GB) . |
| WO 94/25939 | 11/1994 | (WO) . |
| WO 95/01459 | 1/1996 | (WO) . |

OTHER PUBLICATIONS

International Preliminary Examination Report, App. No. PCT/EP99/04083, Mar., 2000.

* cited by examiner

*Primary Examiner*—Tho Phan
(74) *Attorney, Agent, or Firm*—Flynn, Thiel, Boutell & Tanis, P.C.

(57) ABSTRACT

A passage control device for non-contacting data carriers has an antenna unit (5) with a front wall (12) extending in the passage direction and facing the passageway, the height of said wall corresponding to the different wearing heights of the data carriers, and said wall having disposed thereon at least one antenna (13, 14) for data transmission in the radio wave range, and a turnstile (4) with an obliquely downward pointing hinge pin (8) and barrier arms (10) extending obliquely to said hinge pin. The front wall (12) of the antenna unit (5) extends downward beyond the bearing of the turnstile (4). The turnstile (4) is mounted on the area of the antenna unit (5) on the front in the passage direction (15), and the portion (17) of the front wall (12) extending downward beyond the turnstile bearing extends obliquely rearward. The front wall (12) of the antenna unit (5) is designed as an information surface (18) for optical information.

11 Claims, 2 Drawing Sheets

PASSAGE CONTROL DEVICE FOR NON-CONTACTING DATA CARRIERS

This invention relates to a passage control device for non-contacting data carriers, having an antenna unit with a front wall extending in the passage direction and facing the passageway, the height of said wall corresponding to the different wearing heights of the data carriers, and said wall having disposed thereon at least one antenna for data transmission in the radio wave range, and a turnstile with an obliquely downward pointing hinge pin and barrier arms extending obliquely to said hinge pin.

Such a passage control device is known (DE 9490094 U1).

For non-contacting passage control the person to be checked wears a transponder, e.g. in the form of a watch or in the form of a card in a pocket of his clothing, as a data carrier to interact with a transceiver via the antenna in the radio wave range for power consumption and data transmission.

Data transmission is limited to the area directly in front of the antenna. The time the person to be checked takes to passes the antenna must therefore correspond to the transaction time necessary for data transmission, resulting in a relatively great length of the antenna unit of 30 cm to 80 cm for example. On the other hand, the antenna must also have a considerable height of 40 cm to 100 cm for example to take account of the different sizes of the persons to be checked (child/unusually tall adult) and the data carrier location at different heights on the person (trouser pocket/pocket on upper arm). In addition, at least part of the electronics of the transceiver is accommodated in the antenna unit so that it also has a certain depth.

The antenna unit thus forms a massive, fairly unattractive box. When a plurality of passageways with such antenna units are disposed side by side this considerably increases the impression of massiveness.

Various measures have been taken to give the antenna unit a more agreeable appearance. For example, as indicated by the prior art cited above, the antenna unit has been provided with a bulge having an axis of curvature extending in the passage direction. The resulting concave shape of the large-surface front wall suggests a technicity which does reduce the optical impression of massiveness, but not to a satisfactory degree. In addition, the bulged shape of the antenna unit involves considerable additional production effort.

To improve the appearance of the antenna unit, its front wall and its front and rear walls have further been given a transparent design. However, the two large transparent surfaces involve considerable costs. Also, they require an arrangement of all electronic components apart from the antenna in the edge area and thus an additional expenditure.

The problem of the invention is to provide a non-contacting passage control device with an optically agreeable antenna unit at low production cost.

This is obtained according to the invention in that the front wall of the antenna unit, together with at least one antenna, extends downward beyond the bearing of the turnstile, the turnstile is mounted on the area of the antenna unit on the front in the passage direction, and the front wall portion extending downward beyond the turnstile bearing extends obliquely rearward.

This forms a large effective antenna area, ensuring through its great length before the turnstile an accordingly long time of passage for the person to be checked from entrance into the range of the antenna up to the turnstile, and thus a long transaction time for data transmission, and ensuring through its great height that the data carriers can be worn by the persons going through the passageway at a great variety of heights (e.g. child/adult; e.g. trouser pocket/headwear). To prevent garments or the like from being jammed, the lower portion of the front wall of the antenna unit is inclined rearward.

The front wall of the antenna unit extending in the passage direction and facing the passageway is preferably formed at least in the upper area as an information surface for optical information. This gives the front wall an additional function, eliminating the optical impression of massiveness of the antenna unit. Perception of the information makes other impressions retreat into the background for the viewer.

The optical information provided on the front wall of the antenna unit can be designed in different ways. It may involve alphanumeric and/or pictorial information, or possibly moving pictures. If the passage control device is used for access to a lift or cable car, the front wall can be provided for example with a map of the particular area or be designed as an advertising surface. It is also possible, for example at a ski lift, to design the front wall as a mirror for the winter landscape.

The front wall can be provided with permanent information, for example a map, or with variable information. In the latter case the front wall can have clamping or magnetic holders for posters or spaced-apart guides with grooves for insertion of an information sign at its edges, for example. The front wall can further be designed so as to be illuminated, optionally also by interior lighting.

Further, the front wall of the antenna unit can be provided with a depression in which a poster, a sign or similar flat information material can be fastened. In particular if a plurality of passageways are disposed side by side, not only the front wall of the antenna unit can be designed as an information surface, but also the rear wall thereof.

In view of its agreeable appearance even when of large dimensions, the inventive antenna unit is very well suited for providing a plurality of antennas.

One uses non-contacting data carriers in which different carrier frequencies are used for data transmission in the radio range ($10^4$–$3.10^9$ Hz). For example, there are data carriers working with 13.56 MHz, a carrier frequency provided according to an ISO standard, and others with a different, e.g. manufacturer-specific, carrier frequency. Data carriers are also known in which a change of frequency is effected, for example after card identification, for safer and faster data transmission ("frequency hopping") (cf. EP-A-0642096).

In the following an embodiment of the inventive passage control device will be explained in more detail with reference to the drawing, in which.

Figure 1:
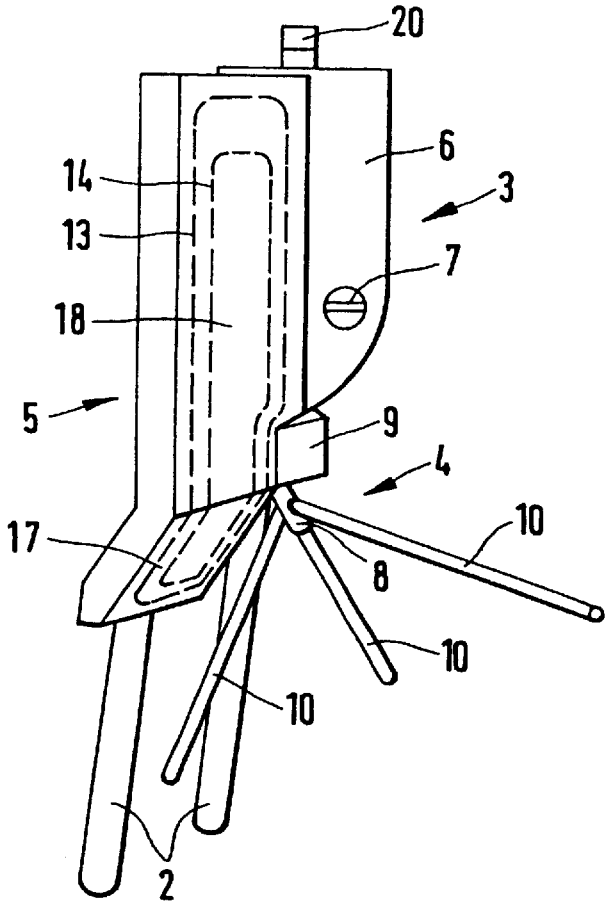
FIG. 1 shows a perspective view of the passage control device.

Accordingly, passage control device 3 is disposed in vertically adjustable fashion on frame 2 at passageway 1.

Passage control device 3 has turnstile 4, antenna unit 5 and further attachment 6 having a device for reading passive data carriers to be inserted into slot 7.

Turnstile 4 is fastened to frame 1 as an attachment, antenna unit 5 to turnstile 4 as an attachment, and attachment 6 to antenna unit 5.

Turnstile 4 has hinge pin 8 pointing obliquely downward to passageway 1 at an angle of about 45°, being mounted in housing 9 and bearing a plurality of barrier arms 10 disposed at an angle of about 45° to hinge pin 8. Housing 9 contains a driving motor. Further, an optoelectric sensor is provided for operating the turnstile drive (not shown) which can at the same time drive one- or multicolored traffic light 20 indicating to the operating staff whether the particular data carrier has operated turnstile 4 or not.

Antenna unit 5 consists of large-surface front wall 12 facing passageway 1, rear wall 13' parallel thereto, and narrow side walls 22, 23. On the inner side of front wall 12 there are two antennas 13, 14 (shown by dashed lines) of a transceiver (not shown) which extend substantially parallel to the contour of antenna unit 5. Outer antenna 13 can be designed for example for a carrier frequency of 125 kHz, inner antenna 14 for a carrier frequency of 13.56 MHz.

The power consumption of the non-contacting, active data carriers designed as transponders is effected via antennas 13, 14, as well as the communication between said data carriers which the persons to be checked are wearing somewhere on their bodies, for example on their clothing, and the transceiver (not shown) of passage control device 3.

The reach of antennas 13, 14 is limited to a few decimeters so that the transaction between the non-contacting data carrier and the transceiver is restricted to the time the person to be checked takes to pass antennas 13, 14. The transaction time necessary for interaction between the non-contacting data carrier and the transceiver thus determines the length of antenna unit 5. On the other hand, the height of antenna unit 5 is determined by the different heights at which the data carriers are worn by the persons going through passageway 1 (child/adult; e.g. trouser pocket/upper arm). The antenna unit thus also has a corresponding height, for example 70 cm, at a length of 50 cm for example. Instead of two antennas, one can also provide only one antenna for two different data transmission frequencies on front wall 12.

Figure 2:
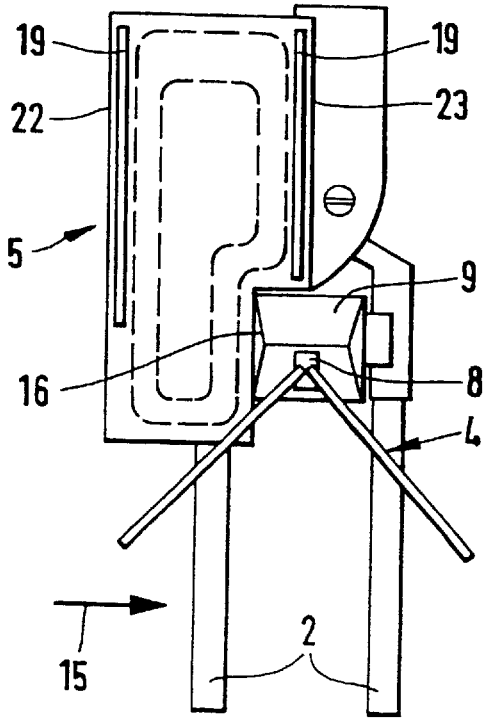
FIGS. 2 and 3 show front and side views of said device.
Figure 3:
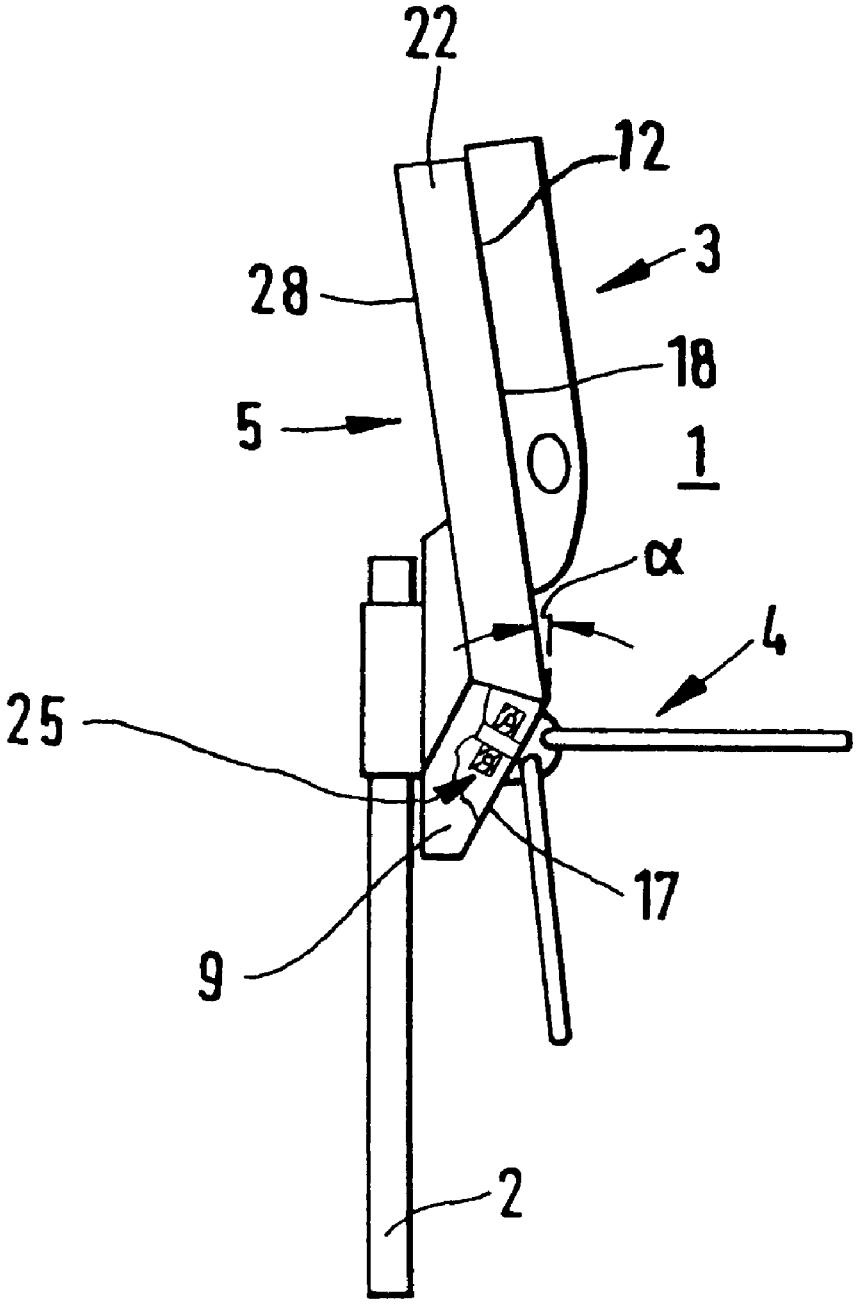

Housing 9 in which turnstile 4 is mounted is disposed on the edge of antenna unit 5 on the front in the passage direction (arrow 15 in FIG. 2), in recess 16 in the lower area of otherwise rectangular antenna unit 5. This ensures reliable singling of persons, i.e. prevents a person from standing between a person with a non-contacting data carrier before antenna unit 5 and turnstile 4 and passing unauthorized through turnstile 4 upon operation of turnstile 4 by said person wearing said non-contacting data carrier.

Antennas 13, 14 and thus antenna unit 5 extend downward beyond housing 9 or the turnstile bearing. To prevent garments or the like from being jammed between rotating barrier arms 10 and antenna unit 5, portion 17 of antenna unit 5 is inclined obliquely rearward away from passageway 1 below the area of turnstile housing 9.

The large upper area of antenna unit 5 above the area of turnstile housing 9, which is flat like lower portion 17, is designed as information surface 18. For this purpose portion 18 can have for example guides 19 for insertion of an information sign (not shown) onto which e.g. an adhesive foil can be stuck on the inside and outside. This eliminates the massive optical impression which large box-shaped antenna unit 5 would otherwise convey. The information can also cover front wall 12 all over, i.e. including lower portion 17.

The upper portion of antenna unit 5 and thus information surface 18 are inclined slightly rearward away from passageway 1, for example at angle of inclination $\alpha$ of 5 to 20°, to obtain an optimum viewing angle for the persons going through passageway 1 onto information surface 18. At the same time this facilitates insertion of a contact-type or magnetically working data carrier into slot 7 of attachment 6 since inclined information surface 18 prevents the person's shoulder from coming in contact with information surface 18 during insertion.

Front wall 12, including lower portion 17, can also have a convex shape bulging toward passageway 1, i.e. be formed without an edge between the upper portion of antenna unit 5 and lower portion 17.

In the inventive control device, front wall 12 of antenna unit 5, together with at least one antenna 13, 14, thus extends downward beyond the bearing or hinge pin of turnstile 4. Bearing 8 of turnstile 4 is mounted in the area of antenna unit 5 on the front in passage direction 15, whereby portion 17 of front wall 12 extending downward beyond turnstile bearing 8 extends obliquely rearward.

This forms a large effective antenna area or front wall 12, ensuring through its great length before the turnstile in passage direction 15 an accordingly long time of passage for the person to be checked from entrance into the range of at least one antenna 13, 14 up to turnstile 4 and thus an accordingly long transaction time for data transmission, while its great height ensures that the data carriers can be worn at quite different heights by the persons going through the passageway. In order to prevent garments and the like from being jammed, lower portion 17 of front wall 12 of antenna unit 5 is inclined rearward away from passageway 1. Thus formed large front wall 12 of antenna unit 5 results at the same time in a large surface which is most suitable for use as information surface 18.

What is claimed is:

1. A passage control device for non-contacting data carriers, said passage control device having: an antenna unit with a front wall extending in the passage direction and facing the passageway, the height of said wall corresponding to the different wearing heights of the data carriers, and the front wall having disposed thereon at least one antenna for data transmission in the radio wave range, the front wall defining a passage space through which individuals transit by said passage control device; and a turnstile with an obliquely downward pointing hinge pin, a bearing that rotatably mounts said hinge pin to said antenna unit and barrier arms that extend obliquely to said hinge pin, wherein:

the front wall of the antenna unit extends downward beyond the bearing of the turnstile;

the turnstile is mounted to a portion of the front of the antenna unit so that the barrier arms extend into the passage space and the front wall of the antenna unit has a lower portion that is located below the turnstile bearing that extends obliquely rearward relative to an upper portion of the front wall that is located above the turnstile bearing.

2. The passage control device according to claim 1, wherein, at least the upper portion of the front wall of the antenna unit is designed as an information surface for optical information.

3. The passage control device according to claim 1, wherein, the front wall of the antenna unit has two antennas for two different data transmission carrier frequencies.

4. The passage control device according to claim 1, wherein, the front wall of the antenna unit has one antenna for two different data transmission carrier frequencies.

5. The passage control device according to claim 1, wherein, the turnstile bearing is disposed in a recess defined by the front wall of the antenna unit.

6. The passage control device according to claim 1, wherein, a device for reading a data carrier is disposed on a front edge of the antenna unit, and the upper portion of the front wall of the antenna unit is inclined away from the vertical so as to be inclined away from the passage space at an angle that is oblique to the horizontal.

7. The passage control device of claim 6, wherein the upper portion of the front wall of the antenna unit is inclined 5 to 20° from the vertical.

8. The passage control device according to claim 1, wherein an information projection device designed to display changing information is mounted to the upper portion of the front wall of the antenna unit.

9. The passage control device according to claim 1, wherein an illuminated information surface is mounted to the upper portion of the front wall of the antenna unit.

10. The passage control device according to claim 1, further including an optical device for displaying information about an operational state of the turnstile is mounted to the antenna unit.

11. The passage control device of claim 10, wherein said optical device includes a light assembly that has at least one light that is selectively illuminated.

* * * * *